US005340001A

United States Patent [19]

Ard

[11] Patent Number: 5,340,001

[45] Date of Patent: Aug. 23, 1994

[54] APPARATUS FOR THREADING A DRAWSTRING THROUGH A GARMENT SLEEVE

[76] Inventor: Terry S. Ard, Rte. 3, Box 299, Bladenboro, N.C. 28320

[21] Appl. No.: 2,639

[22] Filed: Jan. 11, 1993

[51] Int. Cl.[5] ..... A41H 43/00

[52] U.S. Cl. ..... 223/50

[58] Field of Search ..... 223/50, 105, 48, 99, 223/103; 24/34, 117, 140, 143, 266; 29/241; 112/121.19

[56] References Cited

U.S. PATENT DOCUMENTS

| | | | |
|---|---|---|---|
| 1,627,610 | 5/1927 | Lundquist | 223/50 |
| 2,477,053 | 7/1949 | Ewer et al. | 223/50 |
| 2,511,247 | 6/1950 | Champlin | 223/50 |
| 2,532,535 | 12/1950 | Biesen | 223/50 |
| 2,604,239 | 7/1952 | Thomas | 223/50 |
| 2,993,455 | 7/1961 | Baize | 223/50 |
| 3,051,102 | 8/1962 | Minchenberg | 223/50 |
| 3,406,610 | 10/1968 | Golden | 223/50 |

OTHER PUBLICATIONS

Atlanta Attachment Company Feb. 18, 1993 "Draw strings are not easy".

*Primary Examiner*—Clifford D. Crowder

*Assistant Examiner*—Larry D. Worrell, Jr.

*Attorney, Agent, or Firm*—Rhodes, Coats & Bennett

[57] ABSTRACT

The present invention is a drawstring threading apparatus for threading a drawstring through a drawstring sleeve in a garment. The drawstring threading apparatus includes a garment mounting assembly for stationing a garment thereto. The drawstring threading apparatus further including a double-acting, fluid cylinder mounted adjacent to the mounting assembly. Slidably mounted within the cylinder is a drawstring threader. The cylinder includes a guide tube apparatus detachably connectable to an opened end of the elongated cylinder. A fluid actuator assembly is operatively connected to the cylinder to drive the drawstring threader between a retracted position and an extended position. As the drawstring threader is driven from the retracted position to the extended position, the drawstring fastener is driveable through a drawstring sleeve formed in a garment such that the drawstring is positioned in an encircling position with the drawstring fastener extending from the drawstring sleeve. When the drawstring fastener is extended in this manner from the drawstring opening, a drawstring is attachable to the drawstring fastener and threadable through the drawstring sleeve as the drawstring threader is driven from the extended position to the retracted position.

21 Claims, 6 Drawing Sheets

APPARATUS FOR THREADING A DRAWSTRING THROUGH A GARMENT SLEEVE

FIELD OF THE INVENTION

The drawstring threading system of the present invention relates generally to apparatuses for assembling garments, and more particularly, to methods and apparatuses for threading a drawstring through a garment sleeve encircling the garment.

BACKGROUND OF THE INVENTION

In the textile manufacturing industry, one costly component of manufacturing garments is the manual labor required to assemble the garments. Reductions in the amount of manual labor required at any step of the garment assembly process can result in substantial reductions in production costs. One labor intensive step in the assembly of garments having a waistline or neckline drawstring is the threading of the drawstring through the drawstring sleeve.

Despite being a time consuming and labor intensive component of assembling a finished garment, drawstring threading apparatuses known in the prior art are inefficient and expensive. The prior art methods and apparatuses for positioning a drawstring require either an excessive amount of manual labor or expensive machinery.

For example, one prior art manual method involves using a flexible threading wire such as the threading wire (Model 3901) sold by Atlanta Attachment Company located at 410 Industrial Park Drive, Lawrenceville, Ga. 30245. The prior art threading wire has a fastener attached to one end for attaching a drawstring. To thread a drawstring with the prior art threading wire, an operator places a garment on a garment mounting assembly that expands. After positioning the garment, the operator must then pick-up the drawstring threading wire. The operator must take the time to carefully and accurately align the drawstring fastener with the opening of the drawstring sleeve while holding the threading wire. The threading wire is then inserted through the garment sleeve such that the drawstring fastener extends from the garment sleeve. A pre-cut drawstring is then attached to the drawstring fastener and the drawstring is pulled back through the garment sleeve resulting in the drawstring being threaded through the garment. The drawstring threader must then be laid down and the garment can then be removed from the garment mounting assembly. The operator must repeatedly pick-up and lay down the drawstring threading wire while placing and removing the garment on the garment mounting assembly. The problem with this manual method is the extensive amount of time taken to manually thread the drawstring.

Other manual threading methods and apparatus are disclosed in U.S. Pat. No. 4,863,079, issued to Holmgren on Sep. 5, 1989; U.S. Pat. No. 4,671,437, issued to Sauger, on Jun. 9, 1987; U.S. Pat. No. 3,688,379, issued to Davis et al., on Sep. 5, 1992.

Various complicated threading machines have also been designed such as the machines disclosed in the following patents: U.S. Pat. No. 2,993,455, issued to Baize on Jul. 25, 1961; U.S. Pat. No. 2,511,247, issued to E. E. Champlin on Jun. 13, 1950; U.S. Pat. No. 3,051,102, issued to A. S. Minchenber, on Aug. 28, 1962; U.S. Pat. No. 3,406,610, issued to B. C. Golden, on Oct. 22, 1968.

Despite the many machines and manual apparatuses designed to thread, the prior art does not disclose an efficient and inexpensive garment drawstring threading system. A drawstring threading apparatus is needed to reduce the amount of manual labor required to position a drawstring in a drawstring sleeve and which also does not entail the use of expensive machinery.

SUMMARY AND OBJECTS OF THE INVENTION

The drawstring threading apparatus of the present invention provides an efficient and inexpensive system for threading drawstrings through garment sleeves such as waistbands and necklines. The drawstring threading apparatus includes a garment mounting assembly, a double-acting fluid cylinder mounted adjacent the garment mounting assembly and a flexible drawstring threader slidably mounted in the fluid cylinder. A fluid actuator assembly is operatively connected to the fluid cylinder for selectively driving the drawstring threader between a retracted position and an extended position.

Attached to one end of the drawstring threader is a drawstring fastener for connecting a drawstring to the drawstring fastener. When the drawstring threader is in the retracted position, the drawstring fastener extends from an open end of the fluid cylinder. A detachable guide tube can be connected to the open end of the fluid cylinder to provide additional support to the drawstring threader. When in the extended position, an intermediate section of the drawstring threader extends from the guide tube and the fluid cylinder. The intermediate section of the drawstring threader is flexible and is positionable into an encircling position.

To thread a drawstring through a garment sleeve such as a waistband, only a short sequence of steps is required. First, an operator places the garment on the garment mounting assembly. Because the fluid cylinder and drawstring threader are mounted adjacent the garment assembly, the operator's hands are left free to position the garment on the garment mounting assembly such that the opening of the drawstring sleeve is placed adjacent to the drawstring fastener. Once the opening of the drawstring sleeve has been positioned adjacent the drawstring fastener, the operator presses a switch on the fluid actuating assembly and the drawstring threader is driven through the garment sleeve such that the intermediate portion of the drawstring threader encircles the garment and the drawstring fastener extends from the drawstring sleeve opening.

A pre-cut drawstring is then attached to the drawstring fastener and the switch of the fluid actuating assembly is released. The release of the switch causes the drawstring threader to be retracted into the fluid cylinder and the drawstring fastener to be pulled from the drawstring sleeve. As the drawstring threader is retracted, the drawstring is threaded through the drawstring sleeve. The operator then removes the drawstring from the drawstring fastener and then removes the garment from the garment mounting assembly to complete the drawstring threading process.

Accordingly, an object of the present invention is to provide an apparatus for quickly and efficiently threading a drawstring through a drawstring sleeve encircling a garment.

Another object of the present invention is to provide a drawstring threading apparatus that eliminates the need of an operator to repeatedly pick-up and lay-down a drawstring threader during the drawstring threading process.

Another object of the present invention is to provide a drawstring threading apparatus having a guide tube that helps support and maintain the alignment of the drawstring threader as the drawstring threader is moved through a garment sleeve.

Other objects and advantages of the present invention will become apparent and obvious from a study of the following description and the accompanying drawings which are merely illustrative of such invention.

DETAILED DESCRIPTION OF THE INVENTION

Figure 1:
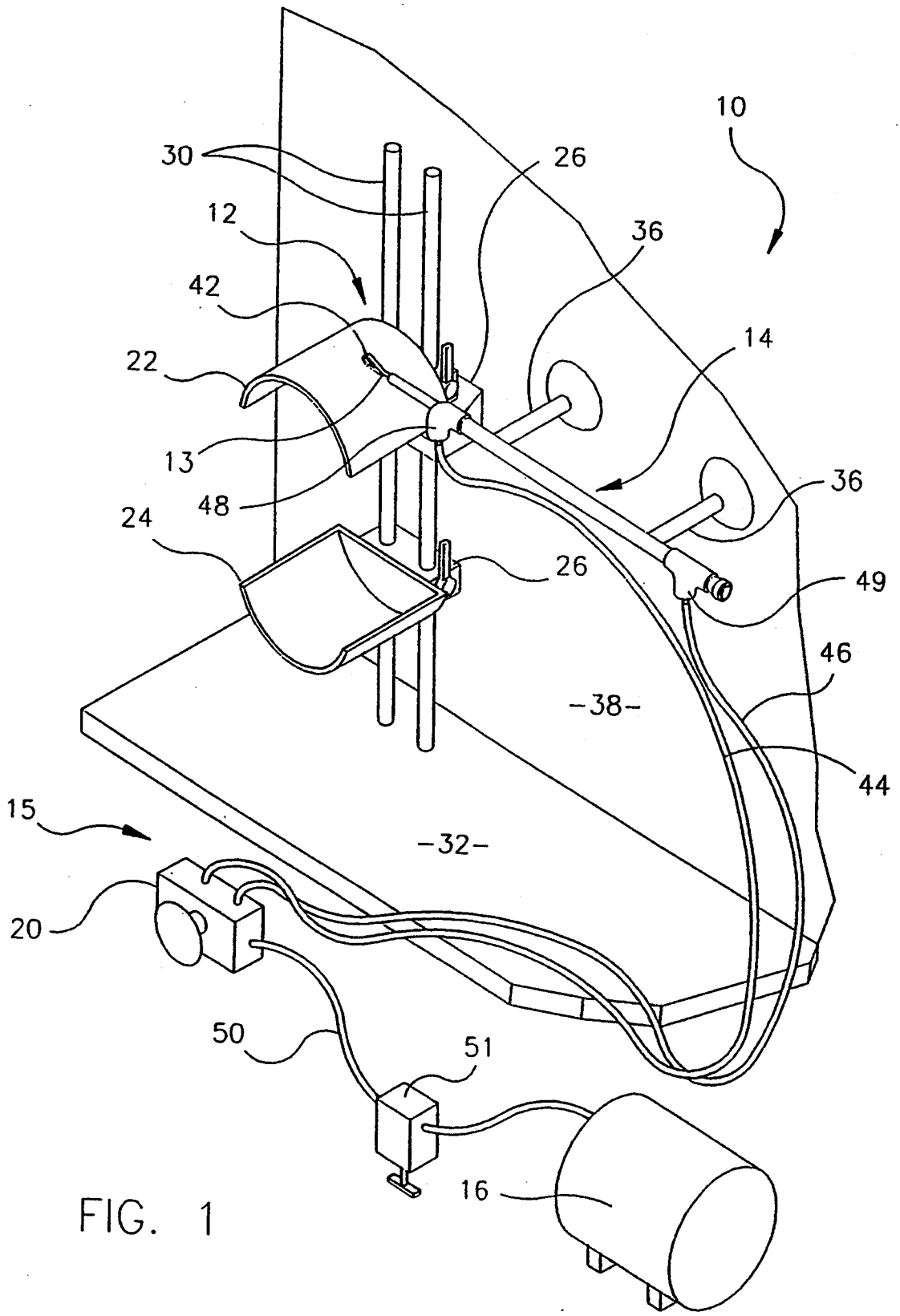
FIG. 1 is a perspective view of the drawstring threading system of the present invention.

Referring to the drawings, the drawstring threading system of the present invention is indicated generally by the numeral 10. Drawstring threading system 10 includes a garment mounting assembly 12, a drawstring threader 13, a double-acting fluid cylinder 14, and a fluid actuating assembly 15. As to be described below, drawstring threading system 10 of the present invention is adapted to thread a drawstring through a pre-formed waistline or neckline sleeve located in a garment.

As shown in FIG. 1, garment mounting assembly 12 is an adjustable expander that includes upper and lower plates 22 and 24. Upper and lower plates 22 and 24 are adjustably mounted onto poles 30 by adjustable mounts 26. Poles 30 extend from a table 32 and upwards along wall 38. Adjustable mounts 26 allow upper and lower plates 22 and 24 to be adjusted in relation to each other to allow for the proper mounting of various sized garments.

Fluid cylinder 14 is mounted to wall 38 by cylinder mounts 36 and is mounted so as to be adjacently positioned to the garment mounting assembly 12. Drawstring threader 13 is slidably mounted within fluid cylinder 14 and includes a fastener 42 connected to one end of the drawstring threader 13. A first air inlet 48 and a second air inlet 49 are formed in the fluid cylinder 14 to allow for fluid introduction into fluid cylinder 14 to control the positioning of drawstring threader 13. A more detailed discussion of fluid cylinder 14 will be provided further below.

Fluid actuating assembly 15 is operatively connected with fluid cylinder 14 to provide for the positioning of drawstring threader 13. Fluid actuating assembly 15 is connected to a fluid source 16 that supplies compressed fluid to the drawstring threading system 10. In the preferred embodiment, the fluid source 16 provides compressed air, but other fluids could likewise be used to position drawstring threader 13. Fluid source 16 supplies compressed air to air pressure regulator 51. Air pressure regulated 51 is adjustable to control the pressure of the compressed air flowing into and through a control line 50.

Control line 50 supplies compressed air to a knee switch 20 which is a dual-position control valve which acts to control the flow of compressed air to and from cylinder 14. In particular, knee switch 20 alternatively connects the source of compressed air to either retraction air line 44 or extension air line 46. Knee switch 20 also acts as an exhaust for the air line 44 or 46 which is not connected to the source of compressed air. As shown in the drawings, extension air line 46 is connected to the second air inlet 49 located at the back end of the fluid cylinder 14, while the retraction air line 44 is connected to the first air inlet 48 located towards the front end of the fluid cylinder 14.

Depression of knee switch 20 directs compressed air into the extension air line 46 which directs the compressed air into second inlet 49 of the fluid cylinder 14. Releasing knee switch 20 redirects air through the knee switch 20 such that compressed air is directed into retraction air line 44 and then into the first air inlet 48. By selectively positioning knee switch 20, compressed air is selectively directed into either the extension air line 46 or the retraction air line 44 to control the positioning of drawstring threader 40.

Figure 2:
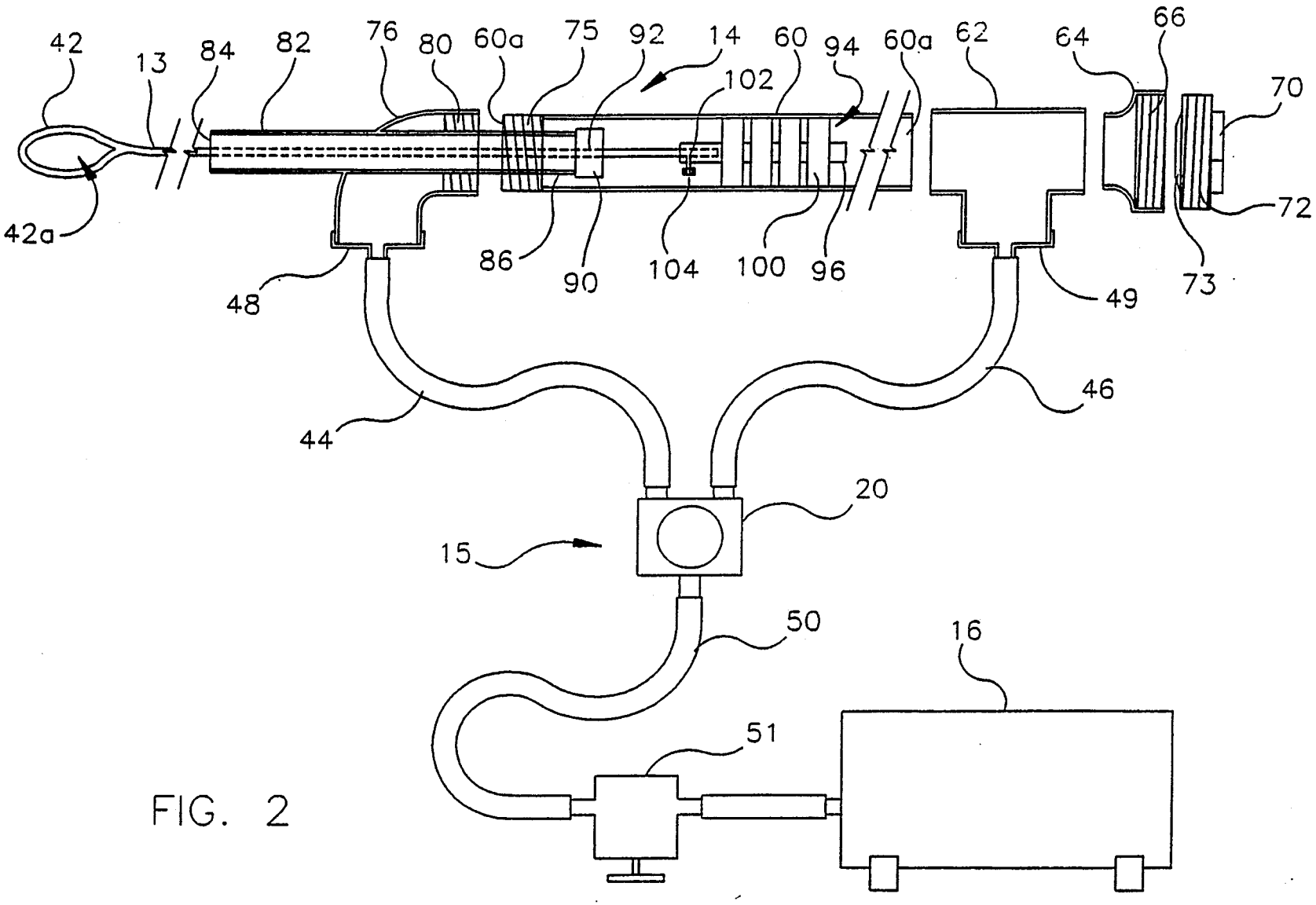
FIG. 2 is an exploded, side cross-sectional view of the cylinder and drawstring threader of the present invention shown connected to the fluid actuating assembly.

Referring to FIG. 2, a more complete description of fluid cylinder 14 will be provided. Fluid cylinder 14 includes a main tube 60 having a first open end **60*a* and a second open end 60*b*. In the preferred embodiment, the main tube 60 is constructed from ½ inch metal tubing. Connected to the second open end 60*b* of main tube 60 is a T-shaped tube 62. T-shaped tube 62 is also constructed of a ½ inch tubing and is soldered onto main tube 60. As shown in FIG. 2, the second air inlet 49 is formed in an opening of T-shaped tube 62. Connected to T-shaped tube 62 is a ½ inch connector tube 64 that is soldered to the T-shaped tube 62 and that includes interior threads 66. A ¾ inch plug 70 is connectable with the connector tube 64 by matching exterior plug threads 72 with threads 66 of the connector tube 64. A rubber stop 73 is connected to the inner end of plug 70 and acts as a shock absorber for a piston 94 slidably mounted in cylinder 14**.

Piston 94 is attached to threader wire 13 and is driven back and forth in cylinder 14 by fluid actuating assembly 15. Piston 94 includes a piston bar 96 that extends longitudinally along the longitudinal axis of the cylinder 14. Connected to plunger bar 96 are a series of bushings 100 which slidably mount plunger 94 within cylinder 14. The plunger bar 96 includes a plunger opening 102 which is sized to accept one end of the drawstring threader 13. A set screw 104 extends transversely into the plunger bar 96 and detachably affixes drawstring threader 13 to plunger bar 96.

Detachably connected to the first open end **60*a* of the cylinder's main tube 60 is an elbow 76. Elbow 76 and main tube 60 have mating threads 75 and 80 that allow for detachable connection between elbow 76 and main tube 60**.

A ¼" guide tube 82 is soldered to elbow 76 and has an open end 84 and an oppositely spaced end portion 86. Open end 84 extends outwardly from elbow 76 and main tube 60, while end portion 86 extends into main tube 60 when elbow 76 is attached to main tube 60. A rubber stop 90 having an opening 92 is attached to the end portion 86 of guide tube 82. Opening 92 is sized to allow drawstring threader 13 to pass therethrough while also providing a seal for end portion 86 of guide tube 82. Rubber stop 90 also acts as a shock absorber for piston 94.

Drawstring threader 13 is constructed from a flexible wire such as a piano wire and includes a threading end that extends outwardly from the open end 84 of guide tube 82. The threading end of threading wire 13 is formed into a closed loop fastener 42 having an eyelet 42*a* sized for passage through a drawstring sleeve in a garment. Fastener 42 is an enclosed loop to help prevent fastener 42 from catching or snagging as the fastener 42 travels through a garment sleeve. The oppositely spaced end of drawstring threader 13 is attached to piston 94 as discussed previously.

Guide tube 82 is designed to support drawstring threader 13 and to have an inside diameter which is smaller than the inside diameter of main tube 60. The smaller relative size of the inside diameter of guide tube 82 with respect to the inside diameter of main tube 60 is advantageous. The relatively smaller inside diameter of guide tube 82 allows for better support of the drawstring threader 13 which extend therethrough, while the larger inside diameter of the main tube 60 provides for a larger surface area for the fluid flow through the cylinder 14 when positioning the drawstring threader 13 within the main tube 60. In addition, the relatively smaller guide tube 82 reduces the amount of physical obstruction that the guide tube 82 presents to an operator using drawstring threading system 10. The smaller the diameter of guide tube 82, the less it will get in the way of an operator's hands as a garment is positioned and a drawstring is threaded through the garment sleeve.

Figure 3:
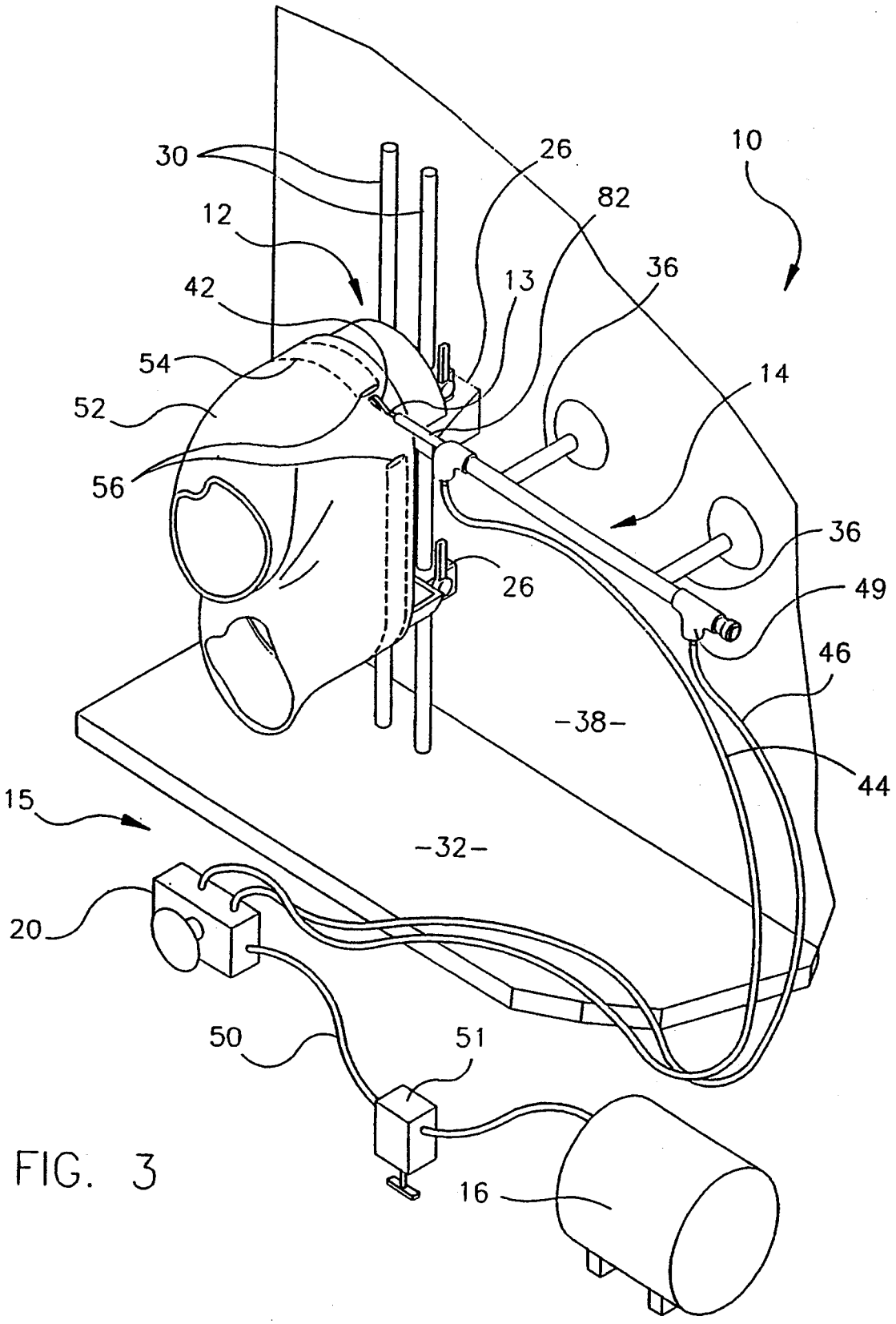
FIGS. 3–6 are a sequence of drawings showing the drawstring threading system of the present invention threading a drawstring through a waistline sleeve in a pair of shorts.

In operation, drawstring threading system 10 threads a drawstring through a garment sleeve as sequentially shown in FIGS. 3–6. Referring to FIG. 3, the initial step for threading a drawstring is mounting a garment such as a pair of shorts 52 on the garment mounting assembly 12. Cylinder 14 is in a retracted position initially and, as shown in FIG. 3, the fastener 42 extends from the open end 84 of guide tube 82 when in the retracted position. The extension of fastener 42 from guide tube 82 while the drawstring threader 13 is in a retraced position enables an operator to easily and accurately position adjacent drawstring opening 56. The shorts 52 are positioned on garment mounting assembly 12 such that the waist is fully expanded into a generally circular shape with drawstring opening 56 positioned adjacent to fastener 42. Because the drawstring threader 13 and cylinder 14 are mounted adjacent one another, the operator's hands are left free to position the shorts 52 on the garment mounting assembly 12 such that the drawstring sleeve opening 56 is positioned adjacent to drawstring threader 42.

Figure 4:
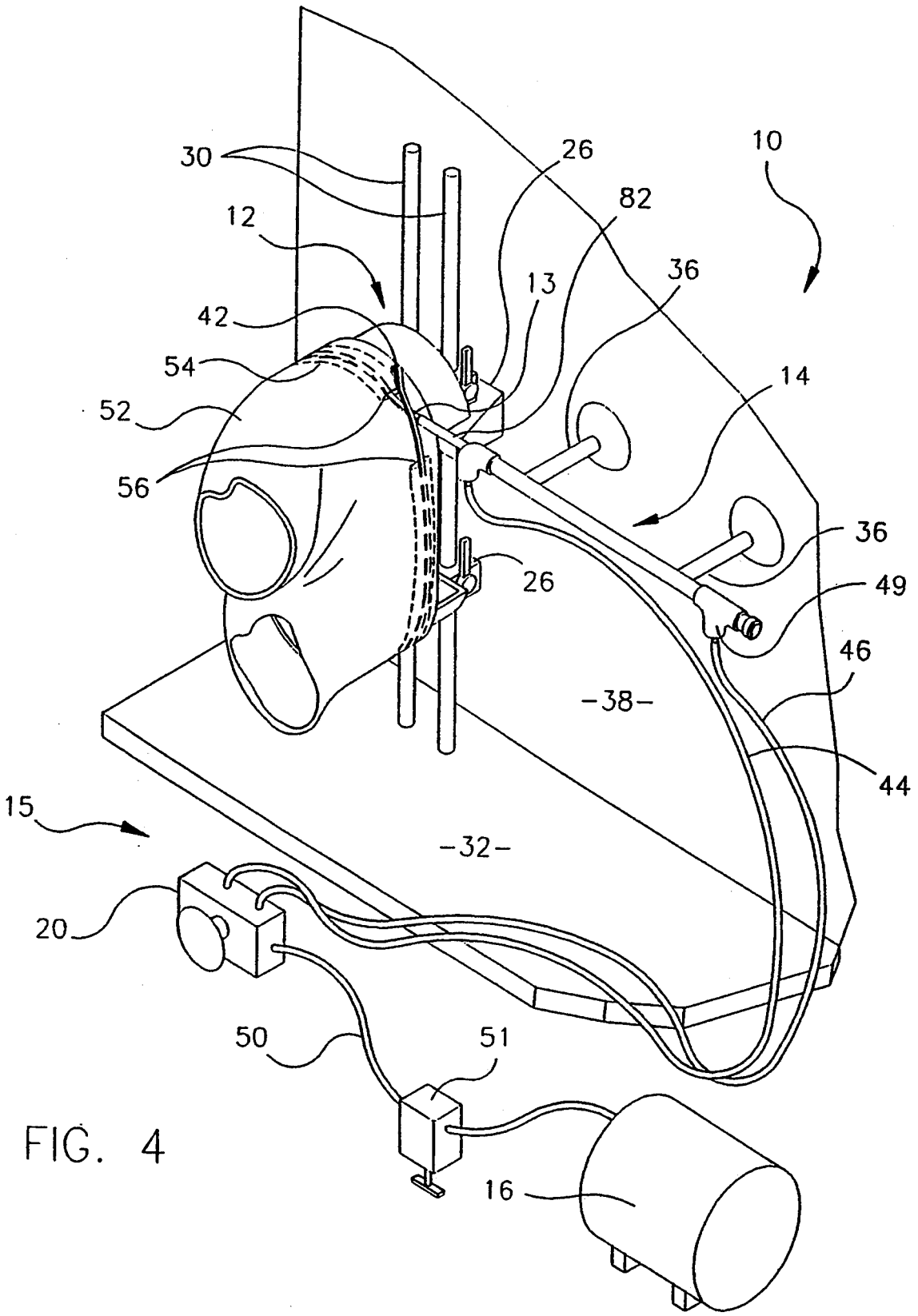

Once in position, as shown in FIG. 3, an operator depresses actuator switch 20 which is positioned just below table 32. Actuator switch 20 is positioned so that an operator can depress the switch with his knee. Upon depressing actuator switch 20, pressurized air from control line 50 is directed through the actuator switch 20 and into extension air line 46. Extension air line 46 directs the compressed air into the second air inlet 49 of cylinder 14. Compressed air directed into the second air inlet 49 drives the plunger 94 and drawstring threader 13 to an extended position causing fastener 42 to be driven through garment sleeve 54 and out of drawstring opening 56. As shown in FIG. 4, an intermediate section of drawstring threader 13 encircles shorts 52 when drawstring threader 13 is driven to the extended position. Air is exhausted through retraction air line 44 and switch 20 during the forward stroke of the drawstring fastener 13.

Figure 5:
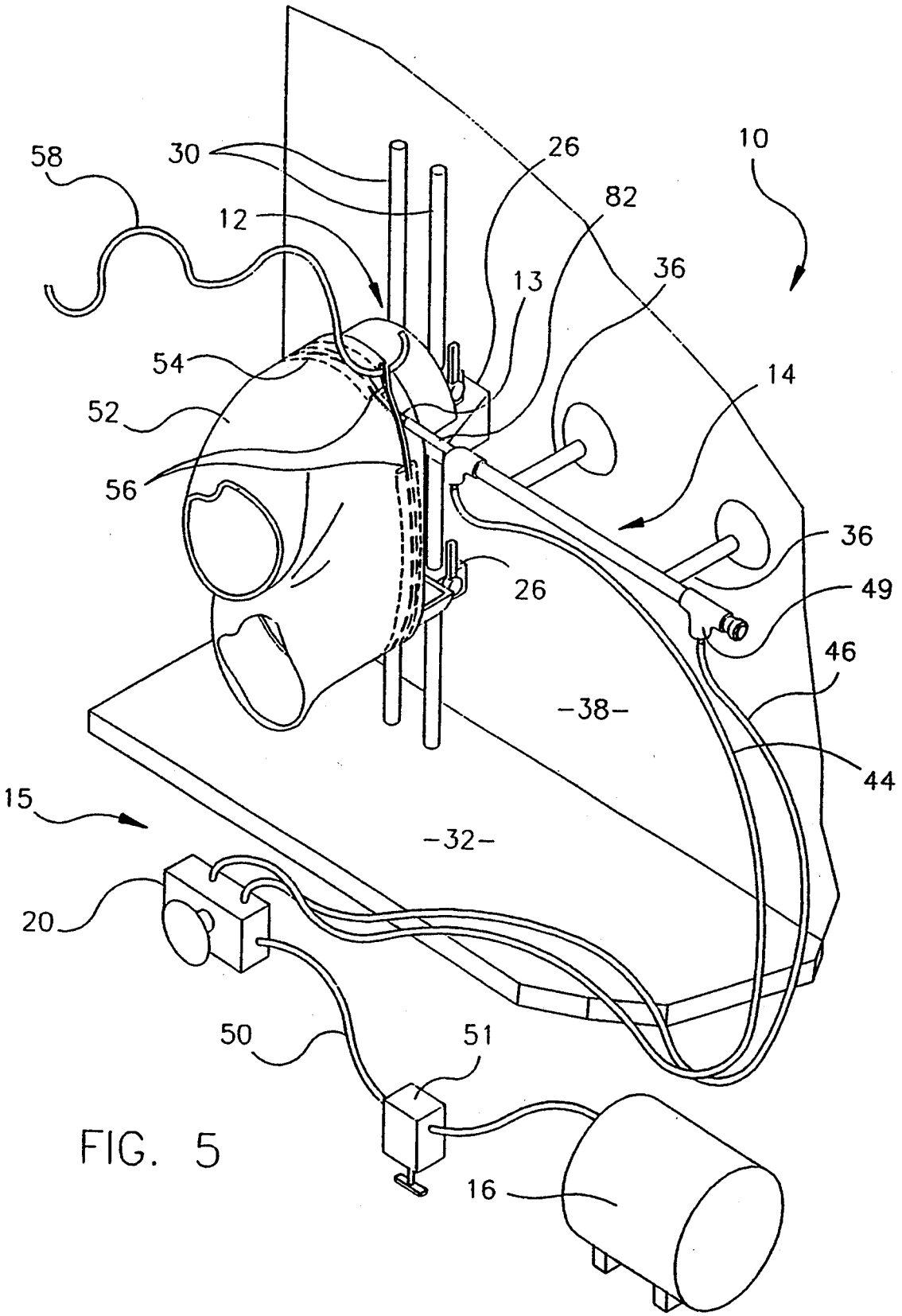
Figure 6:
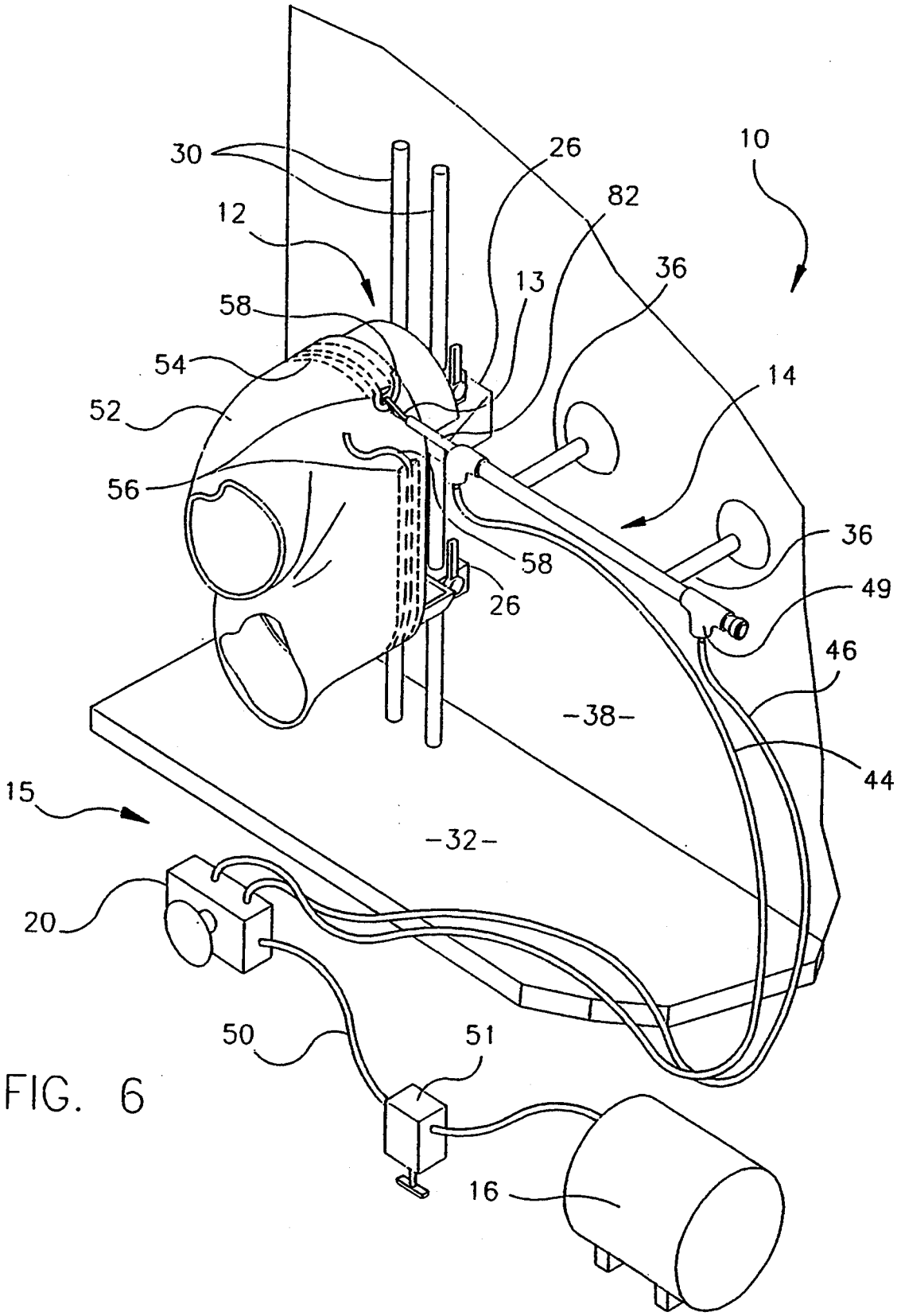

With the drawstring threader 13 positioned through the garment sleeve 54, as shown in FIG. 5, one end of a pre-cut drawstring 58 is inserted into the opening 42*a* of fastener 42. The operator then releases actuator switch 20 causing air from control line 50 to be redirected into retraction line 44. Retraction air line 44 directs air into first air inlet 48 causing compressed air to force plunger 94 and attached drawstring threader 13 to the retracted position shown in FIG. 6. As threader wire 13 is driven from the extended position to the retracted position, the drawstring 58 attached to the fastener 42 is drawn through garment sleeve 54 so as to thread the drawstring 58 through drawstring sleeve 54 as shown in FIG. 6. Once the drawstring 58 has been threaded through the drawstring sleeve 54, an operator removes the attached end of drawstring 58 from fastener 42 and slides the shorts 52 from the garment mounting assembly 12 and the process of threading drawstring 58 is completed.

The drawstring threader 13 is flexible and can be repeatedly positioned from the encircling position shown in FIGS. 4 and 5, and the generally straight position shown in FIGS. 3 and 6. After repeated use of the drawstring threader 13, it may be necessary to replace the drawstring threader 13 due to bending caused by general wear and tear. Cylinder 14 has been designed for easy replaceability of a worn-out drawstring threader 13.

The preferred method of replacing a drawstring threader 13 is by first unscrewing and detaching guide tube apparatus 82. Drawstring threader 13 is then pulled in a forward direction causing plunger 94 to be pulled from the open end of fluid cylinder 14. As shown in FIG. 2, the open end of fluid cylinder 14 is sized to allow for the removal of plunger 94. Once plunger 94 has been removed from fluid cylinder 14, set screw 104 is removed from plunger bar 96 and the end of drawstring threader 13 extending into plunger opening 102 is pulled therefrom. Drawstring threader 13 can then be removed from the guide tube 82. A new drawstring threader 13 is then simply inserted through the guide tube 82 and into plunger opening 102 and set screw 104 is tightened to secure drawstring threader 13 to plunger bar 96. Plunger 94 is then reinserted into main tube 60 of cylinder 14, and the elbow 76 is reattached to the main tube 60.

Cylinder 14 also includes a second method for replacing a worn-out drawstring threader 13. As shown in FIG. 2, cylinder 14 includes detachable plug 70. Drawstring threader 13 can be removed from the back end of the cylinder 14 by removing plug 70. However, because the fastener 42 is too large to be drawn through guide tube 82, fastener 42 must be detached from the drawstring threader 13 so that the plunger 94 and attached drawstring threader 13 can be pulled in a rearward direction and out of the back opening of cylinder 14. Set screw 104 is then loosened and the drawstring threader 13 attached thereto is removed. A new drawstring threader 13 is then inserted through the guide tube apparatus 82 and reattached to plunger 94.

Either of the two above methods for replacing damaged drawstring threaders 13 can effectively be used. The preferred method of replacing the damaged drawstring threader 13 is through a detachable guide tube apparatus 82. Accordingly, a cylinder 14 may be designed without a removable plug 70.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A drawstring threading apparatus for threading a drawstring through a drawstring sleeve in a garment comprising:

(a) a garment mounting assembly;

(b) an elongated cylinder mounted adjacent to the garment mounting assembly and having a first open end;

(c) a piston movably mounted in the cylinder;

(d) a drawstring threader connected to the piston and extending therefrom, the drawstring threader having a first end portion with a drawstring fastener attached thereto and a second end portion connected to the piston, and wherein the elongated member is flexible and includes an intermediate section that is positionable into an encircling position; and (e) a fluid actuator assembly for driving the piston between an extended position where the intermediate section of the drawstring threader extends from the first open end of the cylinder and a retracted position where the intermediate section is at least partially housed within the cylinder, wherein as the piston is driven from the retracted position to the extended position the drawstring fastener is driveable through a drawstring sleeve formed in the garment such that the intermediate section of the drawstring threaded is positioned into its encircling position with the drawstring fastener extending from the drawstring sleeve, and wherein when the drawstring fastener extends from the drawstring opening a drawstring is attachable to the fastener and threadable through the drawstring sleeve as the piston is driven from the extended position to the retracted position.

2. The drawstring threading apparatus of claim 1 further including a guide tube connectable to the first open end of the elongated cylinder and having an inside diameter smaller than the inside diameter of the cylinder.

3. The drawstring threading apparatus of claim 2 further including attachment means for detachably securing the guide tube to the first open end of the cylinder.

4. The drawstring threading apparatus of claim 1 further including attachment means for detachably connecting the drawstring threader to the piston.

5. A drawstring threading apparatus for threading a drawstring through a drawstring sleeve encircling a garment comprising:

(a) an elongated cylinder having a first open end;

(b) a piston movably mounted in the cylinder;

(c) a drawstring threader having a first end portion attached to the piston, a second end portion having a drawstring fastener attached thereto and sized to pass through a garment channel, and a flexible intermediate section formable into an encircling position and sized to extend circumferentially around a garment; and (d) the drawstring threader positionable between an extended position where the intermediate section extends from the first open end of the cylinder and a retracted position where at least a portion of the intermediate section is housed within the cylinder, and wherein as the drawstring threader is positioned from the retracted position to the extended position the drawstring fastener is driveable through a drawstring sleeve formed in the garment such that the intermediate section of the drawstring threader is positioned into an encircling position with the drawstring fastener extending from the drawstring sleeve, and wherein when the drawstring fastener is extended from the drawstring sleeve a drawstring is attachable to the fastener and threadable through the drawstring sleeve as the drawstring threader is driven from the extended position to the retracted position.

6. The drawstring threading apparatus of claim 5 further including a guide tube connectable to the first open end of the elongated cylinder and having an inside diameter smaller than the inside diameter of the cylinder.

7. The drawstring threading apparatus of claim 6 wherein the guide tube includes attachment means for detachably securing the guide tube to the first open end of the cylinder.

8. The drawstring threading apparatus of claim 5 further including piston attachment means for detachably connecting the drawstring threader to the piston.

9. The drawstring threading apparatus of claim 6 wherein the guide tube includes a seal means for sealing an end portion of the guide tube and for absorbing shock and wherein the seal means includes an opening for permitting the drawstring threads to pass therethrough.

10. The drawstring threading apparatus of claim 5 wherein the drawstring fastener extends from the first open end of the cylinder when the drawstring threader is in the retracted position.

11. A drawstring threading apparatus for threading a drawstring through a drawstring sleeve in a garment comprising:

(a) a garment mounting assembly;

(b) an elongated cylinder having a first open end positioned adjacent the garment mounting assembly;

(c) a piston movably mounted in the cylinder;

(d) a flexible drawstring threader having a first end portion connected to the piston, a second remote end portion having a drawstring fastener secured thereto, and an intermediate flexible section;

(e) fluid actuator assembly operatively connected between a pressurized fluid source and the cylinder for selectively driving the piston and drawstring threader between a retracted and extended position, wherein in the retracted position at least a portion of the flexible drawstring threader is housed within the cylinder and in moving towards the extended position a portion of the flexible drawstring threader moves outwardly from the cylinder through the first open end;

(f) the fluid actuator assembly including means for driving the drawstring threader from the retracted position through the first open end of the cylinder, into and through the garment sleeve to where the remote threading end extends out and clear of the drawstring sleeve while the flexible intermediate section of the drawstring threader encircles the garment sleeve, after which a drawstring may be attached to the drawstring fastener; and (g) wherein the fluid actuator assembly further includes means for retracting the drawstring threader from the garment sleeve leaving the drawstring threaded therein.

12. The drawstring threading apparatus of claim 11 further including a guide tube connectable to the first open end of the elongated cylinder and having an inside diameter smaller than the inside diameter of the cylinder.

13. The drawstring threading apparatus of claim 12 further including attachment means for detachably securing the guide tube to the first open end of the cylinder.

14. The drawstring threading apparatus of claim 12 further including piston attachment means for detachably connecting the drawstring threader to the piston.

15. The drawstring threading apparatus of claim 14 wherein the piston includes an elongated bar and a plurality of axially spaced bushings secured thereto, and wherein the axis of the elongated bar extends along the longitudinal axis of the cylinder.

16. The drawstring threading apparatus of claim 15 wherein the bar includes an opening sized to accept the second end portion of the drawstring threader, and wherein the piston attachment means includes a set screw for detachably connecting the second end portion of the drawstring threader within the piston opening.

17. The drawstring threading apparatus of claim 14 wherein the cylinder includes an end plug detachably disposed in the end of the cylinder opposite the first open end.

18. The drawstring threading apparatus of claim 17 wherein the plug includes shock absorber means for absorbing shock from the piston.

19. The drawstring threading apparatus Of claim 12 wherein the guide tube includes seal means for sealing an end portion of the guide tube and for absorbing shock, and wherein the seal means includes an opening for permitting the drawstring threader to pass therethrough.

20. The drawstring threading apparatus of claim 11 wherein the drawstring fastener is a closed loop having an opening sized to accept a garment drawstring.

21. The drawstring threading apparatus of claim 11 wherein the fastener extends from the first open end of the cylinder when the drawstring threader is in the retracted position.

* * * * *